US005641931A

United States Patent [19]

Ogai et al.

[11] Patent Number: 5,641,931

[45] Date of Patent: Jun. 24, 1997

[54] DIGITAL SOUND SYNTHESIZING DEVICE USING A CLOSED WAVE GUIDE NETWORK WITH INTERPOLATION

[75] Inventors: Yoichiro Ogai; Iwao Higashi, both of Hamamatsu, Japan

[73] Assignee: Yamaha Corporation, Japan

[21] Appl. No.: 411,478

[22] Filed: Mar. 28, 1995

[30] Foreign Application Priority Data

Mar. 31, 1994 [JP] Japan ..... 6-085880

[51] Int. Cl.[6] ..... G10H 1/12; G10H 5/00

[52] U.S. Cl. ..... 84/661; 84/659

[58] Field of Search ..... 84/630, 659, 661

[56] References Cited

U.S. PATENT DOCUMENTS

| | | | |
|---|---|---|---|
| 5,136,917 | 8/1992 | Kunimoto | 84/661 X |
| 5,212,334 | 5/1993 | Smith | 84/622 |
| 5,223,653 | 6/1993 | Kunimoto et al. | 84/659 X |
| 5,266,734 | 11/1993 | Komano et al. | 84/607 |
| 5,308,918 | 5/1994 | Yamauchi | 84/622 |
| 5,432,296 | 7/1995 | Takeuchi et al. | 84/661 |
| 5,496,964 | 3/1996 | Suzuki | 84/660 |

FOREIGN PATENT DOCUMENTS 2-267594 11/1990 Japan .

6-67674 3/1994 Japan .

*Primary Examiner*—David S. Martin
*Assistant Examiner*—Jeffrey W. Donels
*Attorney, Agent, or Firm*—Graham & James LLP

[57] ABSTRACT

In a device which excites an oscillating signal in a closed loop containing a delay circuit and a filter so as to synthesize a sound of pitch corresponding to the total delay time in the closed loop, arithmetic operations are performed in the closed loop, in response to a change in a color controlling coefficient caused during generation of the sound, for interpolating delayed output signals from plural points in the loop having different delay time. This interpolation compensates for a variation in the signal delay time in the closed loop resultant from the change in the filter coefficient, to allow the entire closed loop to provide such a total delay time that excites oscillation corresponding to a desired pitch. The closed loop also includes first and second filters. When generation of the sound is to be started, the delay time adjustment or pitch modification is performed by using, as the first filter, an all-pass filter that has the advantage of having no adverse effect on the frequency characteristic of sound. During generation of the sound, so as to avoid the adverse effect resultant from a variation in the coefficient of the all-pass filter, variable control of the delay time or variation control of the pitch is performed by using, as the second filter, a low-pass filter that functions as a delay interpolator.

21 Claims, 4 Drawing Sheets

DIGITAL SOUND SYNTHESIZING DEVICE USING A CLOSED WAVE GUIDE NETWORK WITH INTERPOLATION

BACKGROUND OF THE INVENTION

The present invention relates generally to digital sound synthesizing devices which synthesize a sound signal by generating an oscillating signal by use of a closed wave guide network, and more particularly to a digital sound synthesizing device which modifies the pitch of sound to be synthesized in consideration of signal delay time given by a filter provided in the closed loop of a wave guide network.

U.S. Pat. No. 5,212,334 discloses the fundamental structure for generating and synthesizing a tone waveform signal by use of a closed digital wave guide network. According to the disclosed technique, delay circuitry, filters etc. are connected in closed loop to form a signal circulating path. A digital exciting signal is introduced into and circulated in this circulating path to thereby generate a waveform signal, and then an output tone waveform signal is taken out from a suitable point in the loop. This technique is essentially based on the concept of modelling the physical characteristics of a desired natural musical instrument such as a wind or stringed instrument by means of a closed digital wave guide network to thereby simulate a tone of the natural musical instrument. That is, the signal circulating path (closed digital wave guide network) models the physical propagation of an oscillating signal progressing or reflecting within a medium such as a tube or string of the musical instrument. In the case of simulation of the wind instrument, the above-mentioned signal circulating path corresponds to the tubular portion of the instrument, and the signal delay time simulates the length of the tube to thereby set the resonance characteristic of the tubular portion. Further, the filters inserted in the signal circulating path simulate attenuation and other frequency characteristics of sound waves at the end portion, opening, aperture etc. of the tube, so as to control the color or timbre of a tone to be generated. On the other hand, in the case of simulation of the stringed instrument, the above-mentioned signal circulating path corresponds to the string portion of the instrument. As mentioned, the signal circulating path corresponds to the oscillation generating section of the physical tone source.

The signal circulating path is provided with signal junction sections, as may be necessary, which model the progression and reflection of signals in physical boundaries (oscillation exciting section such as a reed, aperture formed in the tube, mounted ends of the string etc.) along the propagation path of the oscillating signal. For example, the signal junction section for modelling the oscillation exciting portion includes a non-linear conversion section. The signal junction section for modelling the other physical boundaries includes arithmetic operation circuits for separating and synthesizing progressing and reflecting wave signals. The above-mentioned non-linear conversion section for exciting the oscillating signal includes for example a non-linear table. By introducing into the loop of the signal circulating path a suitable electrical pressure signal corresponding to breadth pressure or string-scraping operation, a signal resultant from non-linearly converting the pressure signal by use of the non-linear conversion table is caused to circulate in the signal circulating path so that an oscillating waveform signal is excited. In another case, a noise signal or suitable initial waveform signal is used as the signal to be introduced into the signal circulating path for exciting an oscillating waveform signal.

The signal delay time in the signal circulating path can be variably controlled by changing the number of delay stages in the delay circuit provided within the signal circulating path, so that it is allowed to control the resonance characteristic in the circulating path and thus set/control the pitch of a tone waveform signal to be synthetically formed in the circulating path. In this case, the unit delay time (minimum unit delay time, i.e., delay time given by one delay stage, namely, one delay clock or one sampling clock time) in the delay circuit is constant.

Because each of the filters provided within the signal circulating path presents a phase delay characteristic as well as its original amplitude-frequency characteristic, a very slight signal delay corresponding to the phase delay would undesirably occur in the signal circulating path. Such signal delay time caused by the filter would vary depending on the filter coefficient (i.e., cut-off frequency) and on the signal frequency as well. Particularly, such a phase delay characteristic is very appreciable in an IIR (infinite impulse response) filter having a feedback loop within a filter circuit. Accordingly, the total delay time in the signal circulating path equals the sum of the delay time set to the delay circuit and the signal delay time provided by the filter (if any other delay element is present in the closed loop, the delay time provided by the other delay element as well should, of course, be considered). Thus, in order to synthetically form a tone signal of desired pitch, it is not sufficient to only set the delay time of the delay circuit in accordance with the desired pitch, and it is necessary to compensate for the additional signal delay time provided by the filter.

In this type of technique, the fundamental pitch adjustment method is by changing the number of delay stages in the delay circuit, but changing the number of delay stages alone can only achieve adjustment to an extent corresponding to the unit delay time. In order to compensate for the signal delay time provided by the filter, it is necessary to perform minute adjustment to an extent smaller than the unit delay time in the delay circuit, and hence the intended compensation requires some special approach. Among the traditional pitch adjustment methods is known a technique of interpolating between output signals from different delay stages of the delay circuit (namely, "inter-stage interpolation"). In the past, such an inter-stage interpolation technique was solely employed for achieving a pitch modulation effect such as vibrato, and the use of the inter-stage interpolation for compensation for the signal delay time introduced by the filter was not proposed or considered at all. What should be given particular attention in connection with this type of inter-stage interpolation technique is that an interpolation circuit inserted in the closed loop of the signal circulating path would undesirably function as a low-pass filter to thereby attenuate the high-frequency components of a tone signal more than necessary. Further consideration should be given so as not to cause noise etc. due to delay control operations performed for the required compensation, in attempting to achieve a time-variation in tone color characteristic by time-varying the filter coefficient during generation of the tone.

U.S. Pat. No. 5,308,918 discloses such an inter-stage interpolation technique. Japanese Patent laid-open Publication No. HEI 2-267594 discloses a technique of controlling the delay amount of a delay circuit in response to a change in a filter coefficient, and Japanese Patent laid-open Publication No. HEI 6-67674 discloses a technique of controlling the delay in a closed loop by use of an all-pass filter.

SUMMARY OF THE INVENTION

It is therefore an object of the present invention to provide a sound synthesizing device which synthesizes a sound signal by exciting an oscillating signal in a closed loop including delay and filter elements and which is capable of properly compensating for a variation in signal delay time in the loop occurring in response to a change in a filter coefficient. Particularly, the present invention seeks to provide a pitch adjusting technique that can be advantageously employed against a time-variation of the filter coefficient during generation of a sound.

In order to accomplish the above-mentioned objects, a digital sound synthesizing device in accordance with the present invention comprises a signal circulating section forming a closed loop for circulating therein a digital signal, the signal circulating section including, within the closed loop, a delay section for delaying the digital signal and a filter section for filtering the digital signal, an excitation section for exciting the digital signal in the loop of the signal circulating section, a pitch setting section for, in accordance with a desired pitch, setting signal delay time in the loop, the digital signal being circulated in correspondence to the signal delay time so as to cause oscillation of a sound of the desired pitch in the loop, a filter coefficient supplying section for supplying the filter section with a filter coefficient for controlling a resonance characteristic in the closed loop, and an interpolation section for adjusting the signal delay time in the loop by, in response to a change in the filter coefficient caused during generation of the sound, interpolatively synthesizing outputs from plural points of the loop having different delay time to thereby compensate for a variation in the signal delay time resultant from the change in the filter coefficient.

The signal circulating section and exciting section together constitute an electronic closed-loop tone source, similar to the above-mentioned physical-model type tone source employing the closed wave guide network, which synthesizes a sound signal of pitch corresponding to the total delay time in the loop of the signal circulating section. As the filter coefficient changes for example by the user's manual operation of a suitable color controlling operator to control the color of a sound being generated, the signal delay time in the filter section varies. If no suitable measure is taken, the total delay time in the loop of the signal circulating section will undesirably vary. However, the present invention properly addresses this problem by the provision of the interpolation section. Namely, in response to a change in the filter coefficient occurring during generation of the sound, the interpolation section performs arithmetic operation to interpolate between delayed output signals from plural points in the loop having different delay time, to thereby compensate for a variation in the signal delay time in the loop resultant from the filter coefficient change. By thus interpolating the plural signals having different delay time, it is possible to finely adjust the signal delay time in the entire loop in correspondence to the interpolated delay time. Consequently, by performing the delay time interpolation in such a manner to compensate for the variation in the delay time provided by the filter section, the pitch of the sound obtained can be controlled to not vary.

According to the principle of the present invention, the adjustment is based on interpolation, and hence no noise would occur even when the adjustment is performed during generation of a sound. Further, although there is possibility of the interpolation section inserted in the loop functioning as a low-pass filter as previously mentioned, the associated adverse effect could be estimated to be relatively small because the interpolation is performed in correspondence to time-variation of the filter coefficient, i.e., time-varying control of the color. That is, as compared to such a case where an interpolation circuit is inserted for obtaining steady-state sound color, the adverse effect on the steady-state color resultant from the low-pass filter characteristic attained by the interpolation operation could substantially be reduced in the case where the interpolation circuit is inserted in correspondence to time-varying control of sound color, and hence the merit attained by the interpolation operation which, with a simple structure, permits smooth signal delay time control for pitch adjustment during generation of the sound is greater than the demerit of the unwanted low-pass filter characteristic resulting from the interpolation. Further, where the high-frequency components cut-off by the unwanted low-pass filter characteristic resulting from the interpolation is not very important to realization of the originally intended sound color, the adverse effect of the unwanted low-pass filter characteristic can be even further reduced. Consequently, not a few merits are attained by the present invention which performs interpolation operation of the signal delay time for a pitch compensation corresponding to the filter coefficient change occurring during generation of the sound.

As one mode of embodiment, an all-pass filter may be included in the closed loop. By the linear delay characteristic of the all-pass filter that does not depend on the frequency band of input signal, it is possible to achieve a signal delay smaller than the unit delay time ("decimal delay"). The signal delay corresponding to the unit delay time ("integral delay") is achieved by variably setting the number of delay stages in the delay section. When generation of the sound of the desired pitch is to be started, the pitch setting section subtracts, from the signal delay time of the entire loop corresponding to the desired pitch, filter delay time corresponding to the filter coefficient having been set to the filter section, and the pitch setting section, on the basis of a difference between the signal delay time of the entire loop and the filter delay time, sets delay time to be provided by the delay section. Then, the pitch setting section sets the number of delay stages in the delay section in correspondence to the integer part of a quotient obtained by dividing the delay time corresponding to the difference by unit delay time of the delay section and sets a coefficient of the all-pass filter in correspondence to the decimal part of the quotient, so that the all-pass filter provides delay time corresponding to the decimal part. This arrangement permits minute pitch adjustment. But, it is better to not perform the delay time control via the all-pass filter during generation of a sound, because the decimal value of the signal delay time may greatly change to cause significant noise when the signal delay time must be modified in response to a change in the color controlling filter coefficient during generation of the sound. For example, in the case where the delay time corresponding to a decimal value of "0.9" is set to be provided by the all-pass filter, once a carry occurs, the delay time set by the all-pass filter must be immediately changed to correspond to a decimal part of "0.0", and this results in a sudden delay time change in the all-pass filter, which may often cause noise. Therefore, even in the case where the adjustment control of the delay time is performed by means of the all-pass filter, it is preferable to employ the interpolation operation, as proposed by the present invention, for performing adjustment control of the signal delay time directed to a pitch compensation in response to a change in the filter coefficient during generation of the sound. Because, this could effectively prevent occurrence of noise.

The adjustment of the signal delay time in the entire loop that is performed by the pitch setting section when generation of a sound of desired pitch is to be started may employ any other suitable means than the all-pass filter. For example, when generation of the sound of the desired pitch is to be started, the pitch setting section may subtract, from the signal delay time of the entire loop corresponding to the desired pitch, filter delay time corresponding to the filter coefficient set to the filter section, and may variably set the unit delay time to be provided by the delay, on the basis of such a difference between the signal delay time of the entire loop and the filter delay time. But, since it takes not a little time to calculate proper unit delay time in correspondence to a change in the filter coefficient, it will be more advantageous if such time-consuming calculation is avoided during generation of the sound. Accordingly, even in the case where there is performed adjustment control of the signal delay time in the loop via variable control of the unit delay time, it is very beneficial to employ the interpolation operation, as proposed by the present invention, for performing adjustment control of the signal delay time directed to a pitch compensation in response to a change in the filter coefficient during generation of the sound. Because, this approach can eliminate the need for the time-consuming arithmetic operation during generation of the sound.

As has been set forth above, the adjustment control of the signal delay time performed by the all-pass filter operation, variable control of the unit delay time etc. prior to generation of a sound, and the adjustment control of the signal delay time performed in the form of interpolation during generation of the sound operate very advantageously by supplementing each other, and these adjustment controls when used in combination achieves quite beneficial results that have never been accomplished by the prior art.

Now, the preferred embodiment of the present invention will be described in detail below with reference to the accompanying drawings.

BRIEF DESCRIPTION OF THE INVENTION

DETAILED DESCRIPTION OF THE PREFERRED EMBODIMENT

<Description on Hardware Structure>

Figure 1:
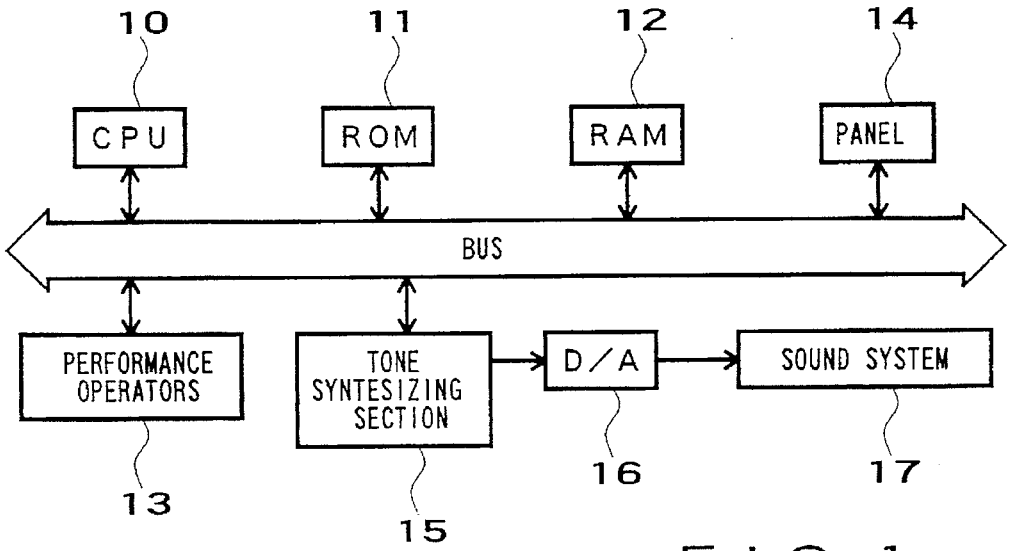
FIG. 1 is a block diagram illustrating an example of the hardware structure of an electronic musical instrument which forms an embodiment of a digital sound synthesizing device in accordance with the present invention.

FIG. 1 is a block diagram illustrating an example of the hardware structure of an electronic musical instrument which forms an embodiment of a digital sound synthesizing device in accordance with the present invention. This electronic musical instrument is provided with a microcomputer section, as a primary control, which comprises a CPU 10, a ROM (read-only memory) 11, a RAM (random access memory) 12, etc. Performance operator block 13 represents a group of performance operators, all in the form of a single blank block for simplicity of illustration, that are worked in real time during performance by a player. Such performance operators may include for example manual and foot-worked operators such as a keyboard for selecting/designating the pitch of tone to be generated, a wheel, joy stick and pedal for controlling the color, volume or pitch of tone, a breath controller and other controllers responsive to the player's gesture or body action, and group of other operating members. The electronic musical instrument may be provided with any one or a plurality of the above-mentioned operating members as necessary. Panel block 14 represents a variety of switches (tone color selection switches, tone volume adjusting switches, effect selection switches, etc.) and a display associated with these switches, all in the form of a single blank block for simplicity of illustration.

Tone synthesizing section 15 operates to synthetically forms a tone signal on a principle similar to that of the above-discussed closed wave guide network, and it can of course synthetically form plural tones in plural channels. This tone synthesizing section 15 may be implemented by use of a dedicated hardware circuit, a DSP (digital signal processor) circuit or a microprocessor that is configured to realize desired tone synthesizing algorithms. The tone signal synthetically formed by the synthesizing section 15 is then converted into analog form via a digital-to-analog converter 16 and then passed to a sound system 17 for audible reproduction or sounding.

The ROM 11 includes a program storage section storing the operation programs for the CPU 10, a parameter data storage section storing tone synthesizing parameter sets corresponding to various preset tone colors/voices, etc. If necessary, the ROM 11 may further include a storage section storing various programs for setting tone synthesizing algorithms in the tone synthesizing section 15. These storage sections may be constructed of separate ROM circuits. The RAM 12 includes a working RAM, a parameter data RAM section for storing various parameters that are set arbitrarily by the user working the performance operator or panel operator in the block 13 or 14, other parameters that are automatically made or rewritten by arithmetic operations, etc. Under the control of the CPU 10, various processes are performed, such as a scanning process for scanning the performance operator block 13 and the panel block 14; various processes based on the results of scanning the performance operator block 13 and the panel block 14 (e.g., a tone generation assignment process for a depressed key, a process for reading out a necessary tone synthesizing program in response to a selected tone color and other factor and transferring the read-out program to the tone synthesizing section 15, and a process for reading out various tone synthesizing parameters selected or made in response to a selected tone color or other factor such as the operation of any of the operators or the result of arithmetic operations) and transferring the read-out parameters to the tone synthesizing section 15.

<Description on the Tone Synthesizing Section 15>

Figure 2:
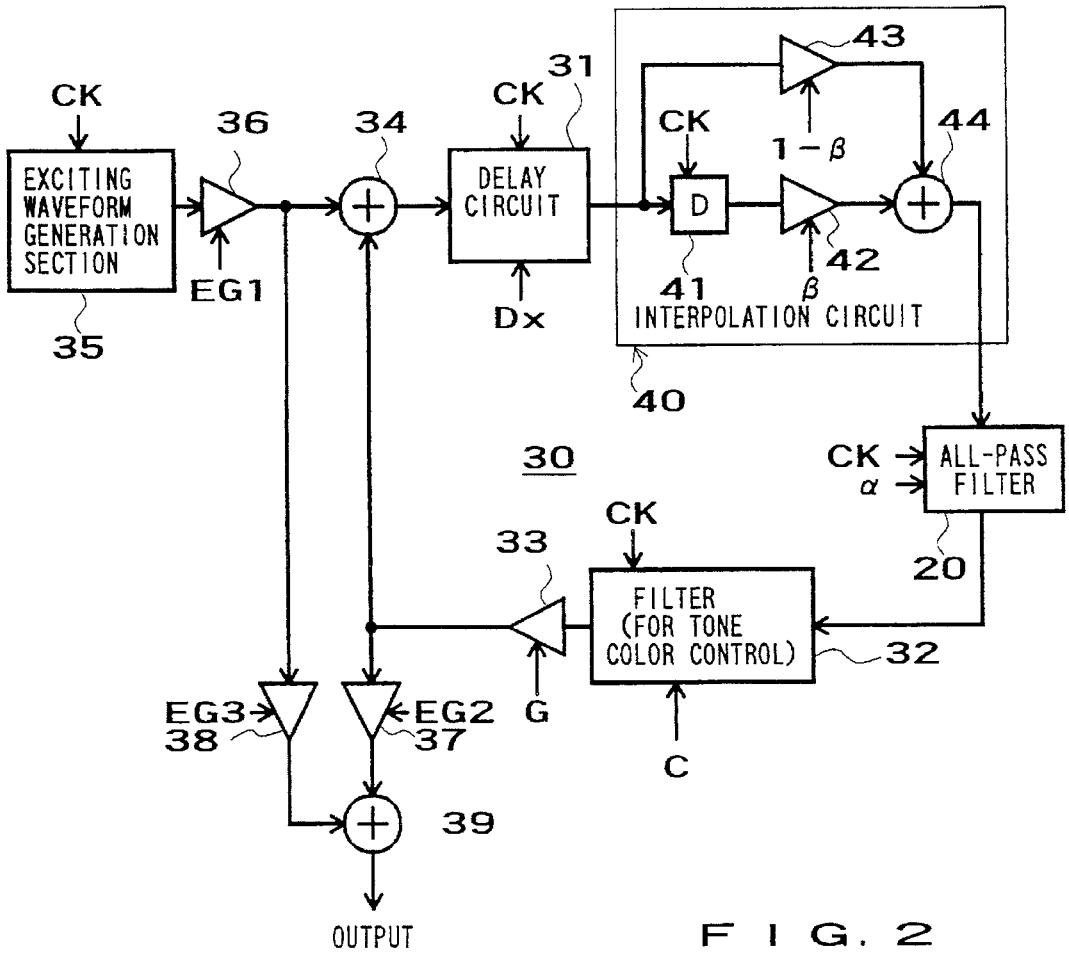
FIG. 2 is a functional block diagram illustrating an example of a tone synthesizing operation algorithm implemented by a tone synthesizing section of FIG. 1.

FIG. 2 shows, in functional block diagram, an example of a tone synthesizing operation algorithm carried out by the tone synthesizing section of FIG. 1.

In FIG. 2, signal circulating section 30, which forms a closed loop for delaying and circulating a digital signal, includes a variable delay circuit 31 for delaying the digital signal and a tone color controlling filter 32. Thus, by controlling the delay time in this closed loop, the signal circulating section 30 controls the resonance characteristic in the loop so as to set the pitch of tone to be synthesized, and propagates the tone signal by repeated circulation of the signal in the loop. Further, the signal circulating section 30 includes a multiplier 33 for variably controlling the gain of the circulating signal, and an adder 34 for introducing an exciting signal into the loop. In the loop of the signal circulating section 30 are also inserted an all-pass filter 20 and an interpolation circuit 40 for adjusting the signal delay time. As conventionally known, the variable delay circuit 31, where implemented by a dedicated discrete hardware circuit, may be constructed of a switching-type multi-stage shift register circuit or the like. If the variable delay circuit 31 is of the program type, it may be implemented by a readable/writable random access memory (RAM).

Exciting waveform generation section 35 is an excitation means for exciting oscillation in the loop of the signal circulating section 30, and it for example generates appropriate noise signal. The noise signal is suitably amplitude-controlled, while a tone is being generated, by suitable envelope waveform data EG1 by means of a multiplier 36 and is then introduced into the signal circulating section 30 via the adder 34. The suitably amplitude-controlled noise signal, after having been introduced into the signal circulating section 30, is delayed by the delayed circuit 31 with its delay amount being finely adjusted by the all-pass filter 20 and interpolation circuit 40 as may be necessary, then controlled in its frequency characteristic by the filter 32, then gain-controlled by the multiplier 33 in accordance with gain control parameter G as may be necessary, and then fed back to the adder 34, so that an oscillating signal is generated in the signal circulating section 30. This oscillating signal generation principle accords with the tone synthesizing principle based on the closed wave guide network which has been discussed earlier as the relevant prior art. The tone color controlling filter 32 acts to control the amount of harmonics of and the attenuation rate of tone to be synthesized by this loop. The characteristics (e.g., cut-off frequency and other filter characteristics) of the filter 32 are set/controlled by filter coefficient C supplied as one of the tone synthesizing parameters as previously mentioned, and as the result the color of the tone to be synthesized is controlled.

The oscillating signal generated in the signal circulating section 30 is taken out from a suitable point of the closed loop to be passed to an amplitude adjusting multiplier 37 and then amplitude-controlled by suitable envelope waveform data EG2 as may be necessary. Further, the oscillation exciting waveform signal output from the multiplier 36 is supplied to a multiplier 38, where it is amplitude-controlled, as may be necessary, by suitable envelope waveform data EG3. Then, the outputs from the multipliers 37 and 38 are additively synthesized by means of an adder 39, and the synthesized result is output as a tone signal. This is for allowing a synthesized tone waveform to be controlled in a various manner by adding the oscillation exciting waveform signal with a suitable amplitude to the oscillating signal generated by the signal circulating section 30. But, this is just illustrative, and the oscillating signal may be suitably amplitude-controlled, with the multipliers 38 and 39 being omitted, and directly output as a tone signal.

The arithmetic operation algorithm for the oscillating signal generation section containing the signal circulating section 30 and oscillation exciting waveform generation section 35 is an utterly illustrative example (and yet significantly simplified for simplicity of description). Any other arithmetic operation algorithm, ranging from a simple to complicated one, or from a known to unknown one, may of course be applied in the present invention, as long as it is in accordance with the tone synthesizing principle based on the closed wave guide network. As the means for exciting oscillation in the closed loop of the signal circulating section, there are known for example such an arrangement where a predetermined initial waveform signal is introduced into the closed loop, an arrangement where an impulse signal is introduced into the closed loop, and an arrangement where a pressure signal for simulating breath pressure is introduced into the closed loop where it is non-linearly converted by use of a non-linear conversion table, and any of these known arrangements may replace the oscillation exciting waveform generation section 35 of the embodiment. Moreover, the signal circulating section 30 may employ a more complicated arrangement where the delay path of a travelling wave and the delay path of a reflecting wave are interconnected via a signal junction, instead of a simple loop as shown in FIG. 2.

According to such a tone synthesizing principle based on the closed wave guide network, there is a definite correlation between the total delay time needed for the signal to make a circulation through the closed loop in the signal circulating section 30, and the frequency of the oscillating signal generated in the loop, i.e., the pitch of tone to be synthesized in the loop, and hence by suitably variably setting the delay time, it is allowed to achieve a desired oscillation frequency, i.e., a desired pitch of tone. This correlation is determined by a model employed as the signal circulating and exciting sections or by an arithmetic operation algorithm. For example, the exciting frequency may correspond to the reciprocal of the total delay time in the loop, or may correspond to the reciprocal of twice the total delay time in the loop. In the example of FIG. 2, the frequency of the exciting signal generated in the signal circulating section 30 (the pitch of tone to be synthesized) corresponds to the reciprocal of twice the total delay time in the signal circulating section 30.

In FIG. 2, if the all-pass filter 20 and interpolation circuit 40 are not considered, the total delay time in the signal circulating section 30 is the sum of the delay time set by the delay circuit 31 and the signal delay time in the filter 32. Where there is any other significant delay circuit, the delay time provided by the other delay circuit is of course added. The number of delay stages in the delay circuit 31 is variably set by control parameter Dx. Basically, the delay time in the closed loop is variably controlled by variably setting the control parameter Dx to thereby variably set the number of delay stages of the delay circuit 31. But, it is not sufficient, and it is necessary to modifies the delay amount allowing for the signal delay time provided by the filter 32. For the purpose of such modification, the all-pass filter 20 and interpolation circuit 40 are provided in this embodiment, as will be later described in detail.

The unit operation time, for one sample of tone signal, in the tone synthesizing section 15 is determined by the generation cycle of sampling clock CK. Namely, the delay operation of each stage of the delay circuit 31 is controlled by the sampling clock CK. Accordingly, if the frequency of the sampling clock CK is represented as "fs" and the number of delay stages set by the control parameter Dx is represented as "Dx", the signal delay time to be provided by the delay circuit 31 will be $$Dx/fs \text{ (second)} \quad \text{[Equation 1]}$$

Figure 3:
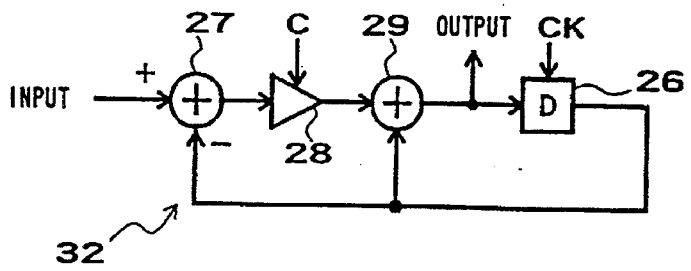
FIG. 3 is a functional block diagram illustrating a structural example of a tone color controlling filter provided within a signal circulating section of FIG. 2.

The sampling clock CK is also supplied to the filter 32 to set the unit operation time in the filter 32. The signal delay time to be provided by the filter 32 is determined by the specific structure of the filter 32. A structural example of the filter 32 is shown in FIG. 3, in which a low-pass filter (LPF) is formed by an infinite impulse response (IIR) filter, which is provided with a unit delay circuit 26 for performing one signal delay in accordance with the sampling clock CK, an adder 27 for subtracting from the filter input signal the signal fed back from the unit delay circuit 26, a multiplier 28 multiplying the output signal from the adder 27 by filter coefficient C, and an adder 29 for adding to the output signal from the multiplier 28 the fed-back signal from the unit delay circuit 26. In the filter 32 thus constructed, the output signal from the adder 29 is provided to the unit delay circuit 26 and taken out as a filter output.

In the case of the filter of FIG. 3, the signal delay amount Dlpf is represented by the following expression. The unit of the delay amount Dlpf is the number of clock pulses each corresponding to the unit arithmetic operation time, i.e, the number of delay stages (meaning the same as the number of delay stages of the delay circuit 31). Namely, if the unit delay time is the same, the delay amount corresponds to the actual signal delay time.

$$Dlpf=C \sin\theta/\{\theta^* (1-C \cos \theta)\}, \quad \text{[Equation 2]}$$

where $\theta=2\pi^*fp/fs$. fp (Hz) is the tone pitch frequency (pitch) of signal input to the filter, and fs (Hz) is the frequency of the sampling clock CK as mentioned earlier. Of course, * is a multiplication mark.

As seen from Equation 2, the signal delay time by the filter 32 varies depending on the value of filter coefficient C. Accordingly, in the case where the filter coefficient C is variably controlled, in real time during performance, by the user via any of the performance operators or panel operators of the blocks 13 or 14 shown in FIG. 1, the signal delay time by the filter 32 may vary during performance of a music piece (each time a tone corresponding to each individual note is generated, or during generation of a specific tone), and the pitch of synthesized tone may fluctuate in response to fluctuation of the total delay time in the loop. So, it is very important to properly compensate for that fluctuation. Of course, the filter 32 may be constructed in any other manner than shown in FIG. 3. The construction of the filter 32 will determine the correlation between the coefficient and the signal delay time.

In order to effect the above-mentioned compensation, this embodiment is designed to adjust the signal delay time using the all-pass filter 20 when generation of each tone is to be started (i.e., immediately before generation of the tone), and to adjust the signal delay time using the interpolation circuit 40 during generation of each tone. The outline of this feature is given below.

First, a description will be made on the signal delay time adjustment by the all-pass filter 20. The signal delaying all-pass filter 20 is provided, in addition to the tone color controlling filter 32, in the signal circulating section 30 of the tone synthesizing section 15, so that a fine delay amount (decimal delay amount) smaller than the unit delay time in the delay circuit 31 is controlled by the all-pass filter 20. It is assumed here that the setting of the delay time by the all-pass filter 20 is performed when generation of each tone is to be started and the delay time once set is not varied during generation of the tone. This is for avoiding the inconvenience that the decimal part abruptly changes, for example, from "0.9" to "0.0" or from "0.0" to "0.9" as the result of a carry to cause noise and other adverse effects to the tone being generated. It will be apparent from consideration of such a purpose that, where no such abrupt change is caused (for example, where the decimal part slightly changes from "0.1" to "0.2"), a modification is also possible where the adjusting control of the signal delay time by the all-pass filter 20 is used even during generation of the tone.

Figure 4:
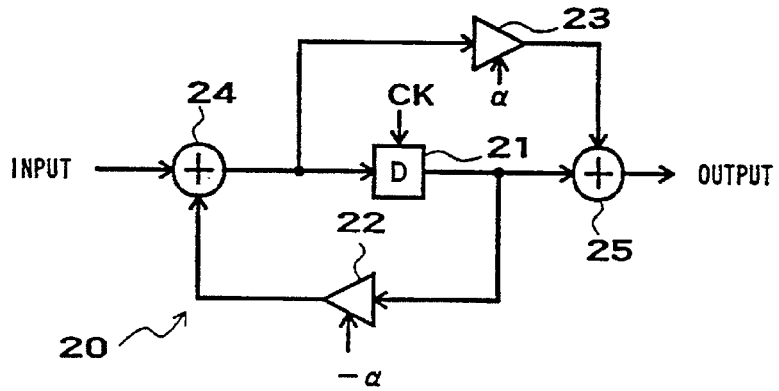
FIG. 4 is a functional block diagram illustrating a structural example of an all-pass filter provided within the signal circulating section of FIG. 2.

A detailed structural example of the all-pass filter 20 is shown in FIG. 4, which includes a unit delay circuit 21, multipliers 22 and 23 and adders 24 and 25. In this all-pass filter 20, an input signal is introduced into the unit delay circuit 21 via the adder 24, the output signal from the unit delay circuit 21 is multiplied by coefficient $-\alpha$ by means of the multiplier 22 and then fed back to the adder 24, the output signal from the adder 24 is multiplied by coefficient $\alpha$ by means of the multiplier 23 and then passed to the adder 25 to be added with the output from the unit delay circuit 21, and the addition result of the adder 25 is output from the all-pass filter 20. By varying the coefficient $\alpha$ within a decimal value range from "0" to "1", this all-pass filter 20 is capable of performing linear delay control independently of the band of the input signal. The signal delay time, i.e., delay amount Dapf in the all-pass filter is determined depending on the value of the filter coefficient $\alpha$ on the basis of the following equation:

$$Dapf=(1-\alpha)/(1+\alpha) \quad \text{[Equation 3]}$$

Assuming that a desired tone pitch frequency is Pn (Hz), the total delay amount Ds in the signal circulating section 30 necessary for achieving the pitch frequency Pn is determined by the following equation, where fs (Hz) is the frequency of the sampling clock CK that sets the unit delay time as mentioned earlier.

$$Ds=fs/Pn \quad \text{[Equation 4]}$$

In this embodiment, first of all, the total delay amount Ds in the signal circulating section 30 that corresponds to the desired tone pitch is calculated using the above-mentioned Equation 4, and then, the signal delay amount Dlpf in the tone color controlling filter 32 is calculated using the above-mentioned Equation 2. Next, as shown in Equation 5, a difference between the total delay amounts Ds and signal delay amount Dlpf is obtained, and then from the integral and decimal parts Di and Df are obtained the delay amount (the number of delay stages) Dx to be provided by the delay circuit 31 and the delay amount (the number of delay stages) Dapf to be provided by the all-pass filter 20. That is, the integral part Di is set as the delay amount (the number of delay stages) Dx to be provided by the delay circuit 31, and the delay amount Dapf is set as the delay amount (the number of delay stages) Dapf to be provided by the all-pass filter 20. At that time (i.e., immediately prior to generation of the tone), no interpolation is performed by the interpolation circuit 40 with its coefficient $\beta$ set at "0".

$$Ds-Dlpf=Di+Df$$

$$Dx=Di$$

$$Dapf=Df \quad \text{[Equation 5]}$$

The filter coefficient $\alpha$ is obtained for example in accordance with the above-mentioned equation 3 on the basis of the thus-determined delay amount Dapf. For instance, the filter coefficient α thus obtained is maintained at a fixed value during generation of the tone.

Next, the control performed during generation of a tone will be described. Once the tone color controlling filter coefficient C is changed during generation of a tone, a new filter delay amount Dlpf' is obtained in accordance with the above-mentioned Equation 2. Then, the new filter delay amount Dlpf', and the delay amount Dapf, namely, Df of the all-pass filter 20 that is fixed during generation of the tone as mentioned above are subtracted from the desired delay amount Ds so as to obtain the delay amount Di'+Df' to be shared by the delay circuit 31 as shown in the following Equation 6. Here, Di' is an integral part, while Df' is a decimal part. Because the delay circuit 31 can only provide the unit delay, the integral part Di' is set as a new number of delay stages Dx, and delay corresponding to the decimal part Df' (delay smaller than the unit delay time) is set in the interpolation circuit 40. That is, the interpolation coefficient β of the interpolation circuit 40 is determined on the basis of the value of the decimal part Df'.

$$Ds-Dlpf'-Df=Di'+Df'$$

$$Di'=Dx \qquad \text{[Equation 6]}$$

β is determined on the basis of Df'.

The interpolation circuit 40 interpolatively synthesizes delayed output signals at plural points corresponding to different delay times in the signal circulating section 30, in accordance with predetermined interpolation formula. A structural example of the interpolation circuit 40 is as shown in FIG. 2, where the circuit 40 includes a unit delay circuit 41, multipliers 42 and 43 and an adder 44. The output signal from the delay circuit 31 (i.e., a first point in the loop having a first delay time) is delayed by one more stage by the unit delay circuit 41, and the delayed output from the delay circuit 41 (i.e., a second point in the loop having a second delay time) is multiplied by coefficient β by means of the multiplier 42. On the other hand, the output signal from the delay circuit 31 is provided to the multiplier 43 to be multiplied by coefficient "1−β". Subsequently, the output signals from the multipliers 42 and 43 are added together by the adder 44, and the output from the adder 44 is caused to circulate in the loop. Thus, a first-order interpolation circuit is formed which, in accordance with the coefficient β corresponding to the value of the decimal section Df', interpolates between the delayed output signal resultant from the delay stages Dx corresponding to the integral part Di' and the delayed output signal resultant from the delay stages that has one more stage than Dx. In the case of such a first-order interpolation circuit, Df' may be equal to β.

In the above-mentioned manner, the interpolation circuit 40 can perform adjustment of the signal delay time in the signal circulating section 30 that becomes necessary due to a variation in the filter coefficient C used for tone color control during generation of a tone (signal delay corresponding to the decimal section Df').

Although not specifically shown in the figure, an envelope waveform generator is provided, in relation to the tone synthesizing section 15, which forms various envelope waveform data (for instance, EG1 to EG3) on the basis of envelope forming parameters (for instance, key-on/key-off information and parameter information for forming a desired envelope waveform). It is to be understood that parameter G for controlling the loop gain of the signal circulating section 30 may also be the envelope waveform data that is generated and time-varied in response to a key-on/key-off event.

<Detailed Examples of CPU Processes>

In this embodiment, the above-mentioned delay amount setting operation processes based on the pitch of tone and filter coefficient is performed by the CPU 10. Therefore, detailed examples of the processes performed by the CPU 10 will be described hereinafter.

Main Routine

Figure 5:
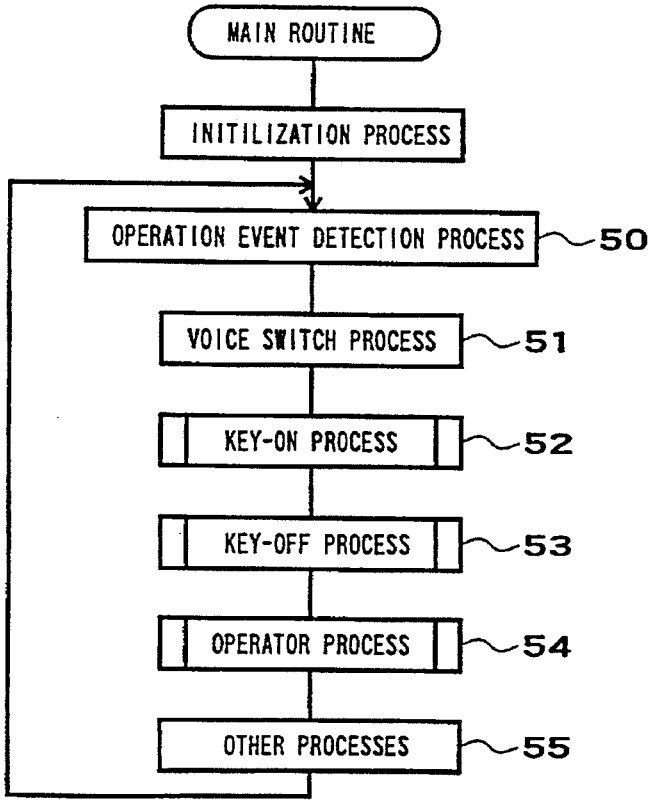
FIG. 5 is a flowchart schematically showing an example of a main routine performed by a CPU (Central Processing Unit) of FIG. 1.

To first describe the main routine performed by the CPU 10 with reference to FIG. 5, the CPU 10 performs a predetermined initialization process upon power-on and then goes to step 50 to perform an operation event detection process. In this operation event detection process, a detection is made of the respective operational states of key switches and other switches and operators in the performance operator block 13 and panel block 14, so as to determine whether or not there has been any change in their operational states (i.e., whether there has been any event). When, for example, there has been any switch-on or switch-off event, the CPU sets up an on-event or off-event flag corresponding to the switch in question. Further, when the operation amount of any of the operators having multiple operating positions such as a joy stick or wheel has changed, the operation amount or movement amount is stored into a register in correspondence to that operator.

Next, in voice switch process of step 51, the CPU 10 reads out, from the ROM 11 or RAM 12, data or parameters necessary for synthesizing a tone of color/voice newly selected or changed by operation of any of the operators in the performance operator block 13 or panel block 14 (in the very beginning, color/voice designated in the initialization process), and transfers the read-out data or parameters to the tone synthesizing section 15 for storage therein. The tone synthesizing section 15 in turn synthesizes a tone signal of color/voice determined by the data or parameters thus transferred and stored. Such data or parameters are also saved in a suitable buffer memory associated with the CPU 10 so as to allow the CPU 10 to refer to the currently selected color/voice data whenever necessary.

Next, in key-on process of step 52, if a key-on event has been detected on the basis of the event flag, preparatory operation necessary for synthesizing a tone of the newly depressed key is performed. This key-on process includes signal delay time adjustment (i.e., pitch adjustment) control, allowing for the delay time of the color controlling filter, that is to be performed prior to generation of the tone. In key-off process of next step 53, if a key-off event has been detected on the basis of the event flag, tone attenuation or tone deadening operation is performed for the newly released key. It should be understood that, where plural tones are generated in plural channels, operation is performed to assign the depressed key corresponding to the key-on event to any suitable tone synthesizing channel as is conventionally well known.

Next, in operator process of step 54, when there has been a change in the operational state of any of the real-time controlling operators in the performance operator block 13 or panel block 14, necessary operation corresponding to the changed operational state is performed. This operator process includes signal delay time adjustment (i.e., pitch adjustment) control, allowing for the delay time of the color controlling filter, that is to be performed when the color controlling filter coefficient has changed during tone generation. In step 55, other necessary processes are performed, after which the CPU 10 loops back to revert to step 50. In this manner, the CPU 10 repetitively performs the main routine from step 50 to step 55.

Pitch Adjustment Process Performed Prior to Generation of Tone

Figure 6:
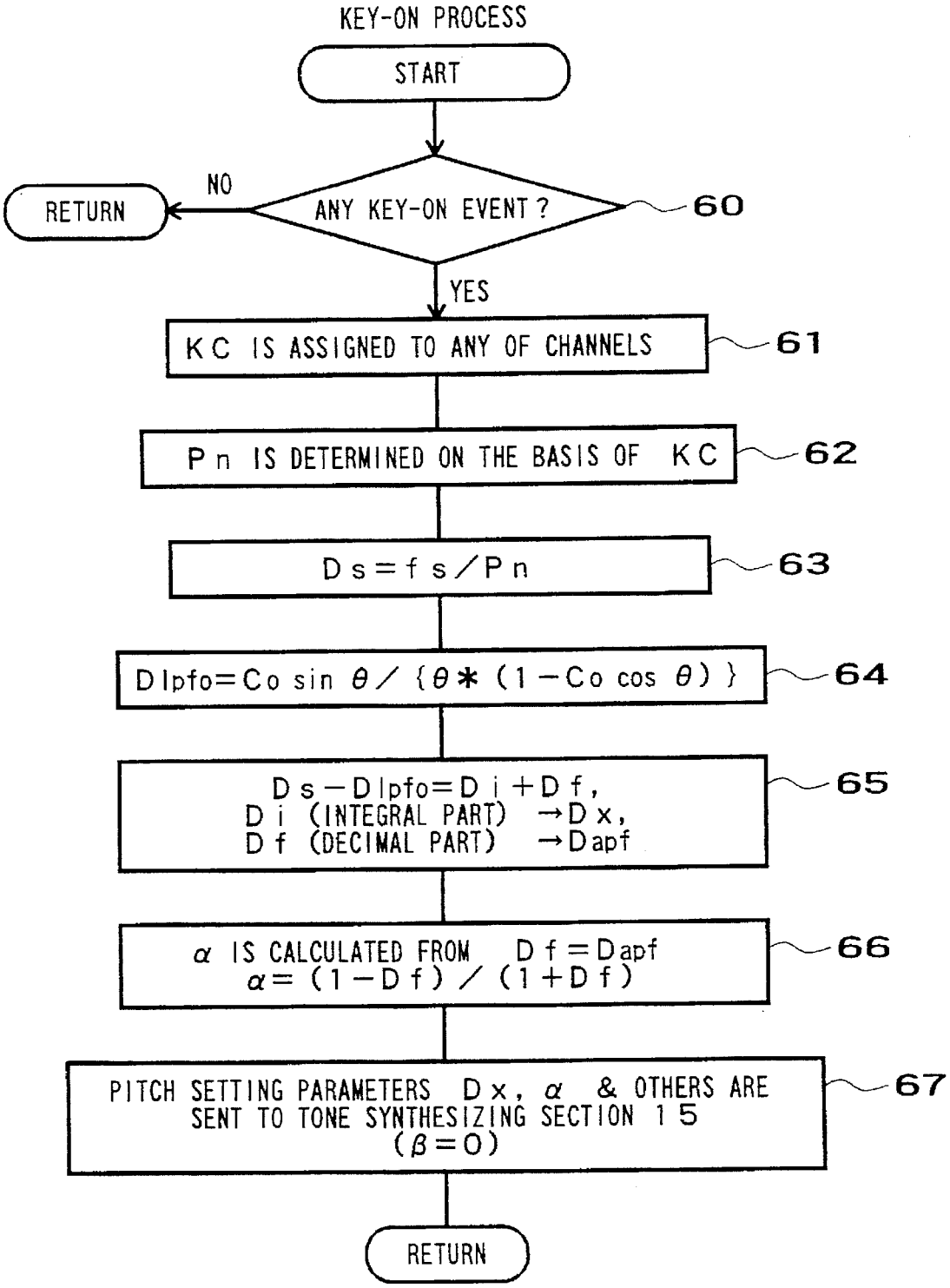
FIG. 6 is a flowchart illustrating an example of a key-on process performed during the main routine of FIG. 5.

FIG. 6 shows a detailed example of the key-on process performed in the above-mentioned step 52 of the main routine. First, in step 60, whether any key-on event is present or not is checked. If a key-on event is present, the CPU 10 continues this step, but if not, the CPU 10 returns to the main routine. In next step 61, operation is performed to assign the key or note associated with the key-on event to any of the tone generation channels. In step 62, on the basis of a key code KC representative of the key or note associated with the key-on event, the frequency Pn (Hz) indicative of the pitch of a tone to be generated is determined. Further, in next step 63, in accordance with the above-mentioned Equation 4, arithmetic operation (Ds=fs/Pn) is performed to calculate the total delay amount Ds in the signal circulating section 30 that is necessary to obtain the desired tone pitch frequency Pn (Hz) on the basis of a predetermined sampling frequency fs (Hz). It is a matter of course that the arithmetic operations of these steps 62 and 63 may be replaced by table readout operations; for example, it is also possible to read out data on the total delay amount Ds, at a stroke, in response to the key code KC associated with the key-on event.

In next step 64, the CPU 10 retrieves, from among tone synthesizing data for the currently selected/set color/voice stored in the buffer memory, the parameter indicative of coefficient C of the filter 32 as an initial parameter Co. Then, the CPU 10 substitutes the initial parameter of the filter coefficient for the filter coefficient C of a predetermined filter delay time computing formula such as the above-mentioned Equation 2, so as to calculate initial signal delay amount (i.e., signal delay amount prior to generation of a tone) Dlpfo of the filter 32 corresponding to the coefficient Co for example in accordance with the equation of $$Dlpfo=Co\ \sin\theta/\{\theta*(1-Co\ \cos\theta)\}$$

In determining the initial parameter Co, consideration may be given not only to the filter coefficient data stored in the above-mentioned buffer memory but also to the operational state of any other color controlling operator. The arithmetic operation used here may also be replaced by table readout operation.

In next step 65, the initial filter delay amount Dlpfo obtained in step 64 is subtracted from the total delay amount Ds obtained in step 63 as shown in Equation 5, so as to calculate the delay amount |Ds−Dlpfo| to be shared by the delay circuit 31 and all-pass filter 20. This delay amount Ds−Dlpfo includes an integral part Di and a decimal part Df as expressed below $$Ds-Dlpfo=Di+Df$$

Of the delay amount Di+Df thus obtained, the integral part Di is set as data for setting the number of delay stages Dx, and the decimal part Df is set as data for setting the delay amount Dapf to be shared by the all-pass filter 20.

In next step 66, in accordance with a predetermined all-pass filter delay time computing formula such as the above-mentioned Equation 3, the CPU 10 calculates the value of filter coefficient α that is necessary for obtaining the delay amount Dapf=Df calculated in the preceding step 65. For example, in the case where the above-mentioned Equation 3 is used, the filter coefficient α may be obtained by inversely operating this equation and substituting thereinto the decimal part Df in accordance with the equation of $$\alpha=(1-Df)/(1+Df)$$

This arithmetic operation may also be replaced by table readout operation.

In next step 67, the CPU 10 provides the tone synthesizing section 15 with the desired pitch setting parameters Dx and α calculated in the above-mentioned manner, and other parameters (such as envelope forming parameters). At this time, "0" is provided as the parameter β of the interpolation circuit 40 so that no interpolation operation on the signal delay time is performed when generation of tone is started. On the basis of various parameters provided, the tone synthesizing section initiates a tone synthesizing process to start generation of tone signal.

Pitch Adjusting Process Performed During Generation of Tone

Figure 7:
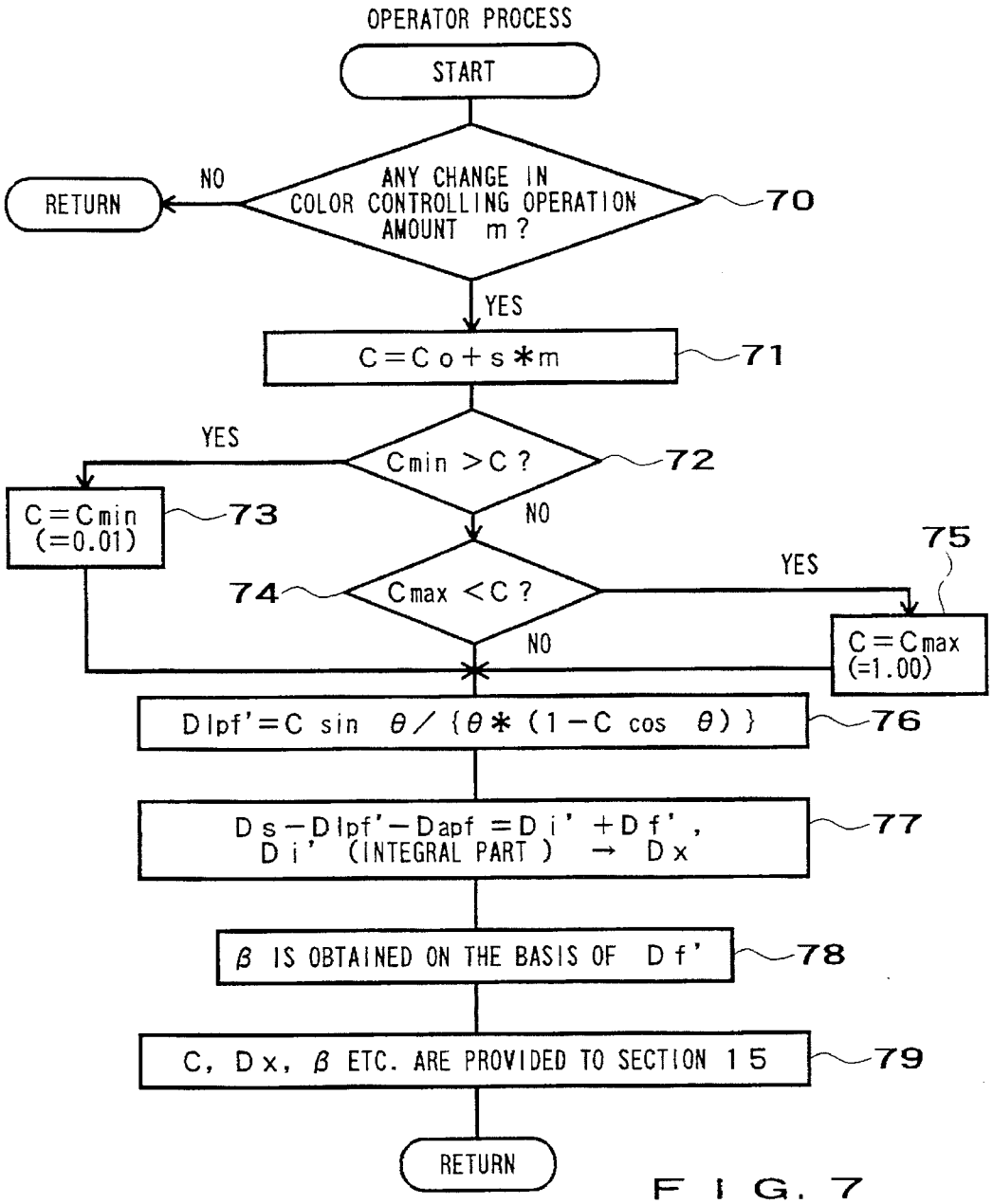
FIG. 7 is a flowchart illustrating an example of an operator process performed during the main routine of FIG. 5.

FIG. 7 shows a detailed example of the operator process performed in the above-mentioned step 54 of the main routine in connection with the color controlling operators. First, in step 70, whether any color controlling operator event is present or not is checked. If answered in the affirmative, the CPU 10 continues this process, but if not, the CPU 10 returns to the main routine. In step 70, it is checked for example whether there has been a change in data m indicative of the operation amount of the color controlling operator. Once the color controlling operator is operated during generation of a tone, the check result of step 70 becomes affirmative, and the CPU 10 proceeds to step 71. In step 71, the operation amount data m of the color controlling operator is arithmetically operated with (e.g., multiplied by) suitable sensitivity parameters to adjust sensitivity of the data, thereafter the data m is arithmetically operated (e.g., added) with the initial parameter Co of the tone controlling filter coefficient, and the arithmetic operation result is provisionally determined as the filter coefficient C of the filter 32. The sensitivity parameters may be determined as desired depending on the particular kind of the selected color/voice.

In subsequent steps 72 to 75, operations are performed to limit the filter coefficient C provisionally determined in the above-mentioned manner. In step 72, it is determined whether the provisionally determined filter coefficient C is smaller than a predetermined minimum value Cmin. If the answer is YES, the CPU 10 goes to step 73 to set the predetermined minimum value Cmin as the filter coefficient C. If, however, the answer is NO, the CPU 10 goes to step 74 to further determine whether the provisionally determined filter coefficient C is greater than a predetermined maximum value Cmax. With an affirmative determination in step 74, the CPU 10 sets the predetermined maximum value Cmax as the filter coefficient C in step 75. This is for the purpose of limiting the variation of the filter coefficient C to within a predetermined range. The predetermined variation range may differ depending on the type of the filter 32, and in the preferred embodiment, the predetermined minimum value Cmin may be 0.01 and the predetermined maximum value Cmax may be 1.00. It is preferable that the minimum value Cmin be of certain minute value in stead of being mere "0".

In next step 76, the filter coefficient C determined in response to the real-time color controlling operation in the above-mentioned manner is substituted for filter coefficient C of a predetermined filter delay time computing formula such as the above-mentioned Equation 2, and the signal delay amount Dlpf' of the filter 32 corresponding to the changed filter coefficient C is calculated by, for example, $$Dlpf'=C\ \sin\theta/\{\theta*(1-C\ \cos\theta)\}$$

This calculation may also be replaced by table readout operation.

In next step 77, the new filter delay amount Dlpf', and the delay amount Dapf of the all-pass filter 20 that is fixed during generation of the tone as previously mentioned are subtracted from the total delay amount Ds corresponding to the desired pitch, so as to calculate the delay amount Di'+Df' to be shared by the delay circuit 31. Here, Di' is an integral part and Df' is a decimal part.

$$Ds-Dlpf'=Di'+Df'$$

The thus-obtained integral part Di' is then set as a new number-of-delay-stage setting parameter Dx of the delay circuit 31. The decimal part Df' corresponds to a delay amount smaller that the unit delay time which can not be achieved by the delay circuit 31. In next step 78, operations are performed to determine the interpolation coefficient β of the interpolation circuit 40 on the basis of the value of the decimal part Df'. The interpolation coefficient β can be determined by performing predetermined arithmetic operation using predetermined interpolation formula or predetermined table readout operation, on the basis of the value of the decimal part Df'. In the case of the first-order linear interpolation as previously mentioned, the value of the decimal part Df' may be directly determined as the interpolation coefficient β as it is.

In next step 79, the CPU 10 provides the tone synthesizing section 15 with the filter coefficient C changed in the above-mentioned manner and the desired-pitch setting parameters Dx, β etc. having been calculated so as to adjust the tone pitch in response to the change in the filter coefficient C. The coefficient α of the all-pass filter 20 is however maintained at the value initially set prior to generation of the tone. The tone synthesizing section 15 in turn performs tone synthesizing operations on the basis of the provided various parameters, so as to generate a tone signal of the changed color at the desired pitch compensated. The process of FIG. 7 is performed in real time each time the filter coefficient C is changed in response to the operation of any of the color controlling operator.

Process Performed Upon Key-off

Figure 8:
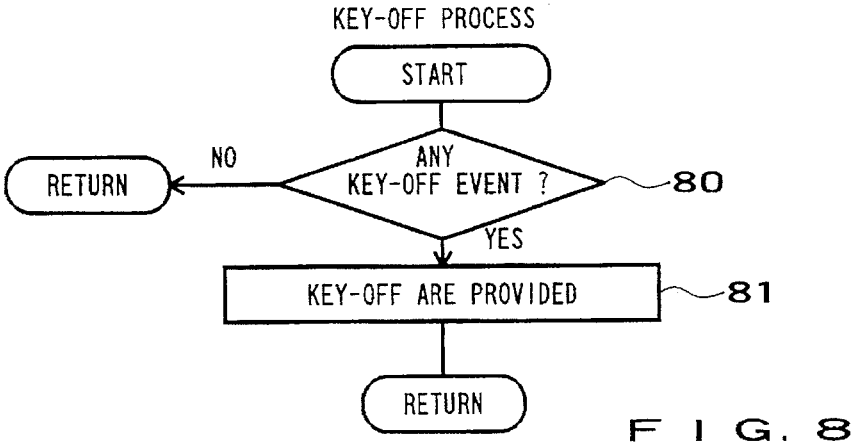
FIG. 8 is a flowchart illustrating an example of a key-off process performed during the main routine of FIG. 5.

FIG. 8 shows a detailed example of the key-on process performed in the above-mentioned step 53 of the main routine. First, in step 80, whether any key-on event is present or not is checked. If a key-on event is present, the CPU 10 continues this step, but if not, the CPU 10 returns to the main routine. In step 81, various key-off parameters (for example, parameter for setting an envelope waveform into the released state) are provided to one of the channels to which the key associated with the key-off event is assigned. In the case where attenuation of generated tone is effected in response to the key-off event, specific color control for the key-off may be performed in an automatic fashion. In such a case, filter coefficient C changed for the key-off is provided, and also operations similar to the operations of steps 76 to 79 of FIG. 7 are performed, so that the desired-pitch setting parameters Dx, β etc. are calculated so as to adjust the tone pitch in response to the change in the filter coefficient C and these parameters are also provided to the tone synthesizing section 15.

Other Embodiments or Modifications

As the means for adjusting the delay time on the basis of the color setting/controlling filter coefficient prior to generation of a tone, any other suitable means than the all-pass filter described above may be employed. For example, this means may be implemented by variably controlling the frequency fs (Hz) of the sampling clock CK, namely, variably controlling the unit delay time in the delay circuit 31. For example, the sampling frequency fs may be variably set in such a manner that, when starting generation of a tone of desired pitch, the integral delay by the delay circuit 31 achieves delay time {(Ds−Dlpf)×(1/fso)} corresponding to a difference |Ds−Dlpf| that is obtained by subtracting the filter delay amount Dlpf corresponding to the filter coefficient C from the signal delay amount Ds of the entire loop corresponding to the desired pitch calculated on the basis of a given reference sampling frequency fso. That is to say, it is sufficient to obtain the sampling frequency fs that establishes (Ds−Dlpf)×(1/fso)=Dx×(1/fs), where Dx is a given integer. In this case, both Dx and fs may be variably controlled.

As previously mentioned, it is a matter of course that various arithmetic operations in the foregoing embodiment may be replaced by table readout operations where variable data is provided as address input to a preset table for immediate retrieval of the answer. Further, in the foregoing embodiment, the color controlling filter 32 may be implemented by any other type filter than a low-pass filter. In such a case, if there is employed a complicated filter whose signal delay characteristic can not be obtained by mathematical formula, filter delay amount data may be obtained by previously determining its actual delay characteristic, making a table storing "coefficient vs. delay amount data" on the basis of the actual measurements and reading out the data from the table. In the case where the filter delay amount is obtained by mathematical formula, the calculation speed can be significantly increased by use of the table. In such a case, similarly to the above-mentioned, approximate answer can be obtained, with respect to such a value not contained in the table, by interpolating between the read-out outputs from the table, and this can substantially save the storage capacity of the table.

In stead of the first-order interpolation arrangement as shown in FIG. 2, the interpolation circuit 40 may employ a multi-order interpolation arrangement such as second-order or third-order interpolation. In such a case, delayed output signals may respectively be taken out from suitable plural delay stages of the delay circuit 31 and then interpolated using predetermined interpolation coefficient. Moreover, the interpolation circuit 40 may be inserted in any position as long as it is within the loop of the signal circulating section 30.

Furthermore, it should be obvious that the present invention can be implemented not only by the software processing as explained in connection with the foregoing embodiment, but also by dedicated hardware circuitry. What is more, it should be appreciated that the present invention is applicable to any other desired sound synthesis than that of musical tone.

According to the present invention so far described, when the filter characteristic has been variably controlled in order to control the color of a sound being generated, the interpolation means interpolates between plural signals having different delay time in such a manner to compensate for a resultant variation in the signal delay time and thereby can minutely adjust the signal delay time in the entire loop in correspondence to the interpolated delay time. This arrangement can smoothly perform such pitch adjustment control that effectively prevents a variation of the pitch of tone obtained. Namely, because the delay time control is based on interpolation, it can not introduce unwanted noise even when it is performed during generation of a tone, and in addition is very suitable for real-time control because it is based on relatively simple arithmetic operations.

What is claimed is:

1. A digital sound synthesizing device comprising:

signal circulating means forming a closed loop for circulating therein a digital signal, said signal circulating means including, within said closed loop, delay means for delaying the digital signal and filter means for filtering the digital signal;

excitation means for exciting the digital signal in said loop of said signal circulating means;

pitch setting means for, in accordance with a desired pitch, setting signal delay time in said loop, said digital signal being circulated in correspondence to the signal delay time so as to cause oscillation of a sound of the desired pitch in said loop;

filter coefficient supplying means for supplying said filter means with a filter coefficient for controlling a resonance characteristic in said closed loop; and interpolation means for adjusting the signal delay time in said loop by, in response to a change in said filter coefficient caused during generation of said sound, interpolatively synthesizing outputs from plural points of said loop having different respective delay times to thereby compensate for a variation in said signal delay time resultant from said change in the filter coefficient.

2. A digital sound synthesizing device as defined in claim 1 wherein, when generation of the sound of the desired pitch is to be started, said pitch setting means subtracts, from the signal delay time of the entire loop corresponding to the desired pitch, filter delay time corresponding to said filter coefficient supplied to said filter means, and said pitch setting means, on the basis of a difference between the signal delay time of the entire loop and the filter delay time, sets delay time to be provided by said delay means.

3. A digital sound synthesizing device as defined in claim 2 wherein said pitch setting means includes an all-pass filter inserted in said loop, and wherein said pitch setting means sets the number of delay stages in said delay means in correspondence to an integer part of a quotient obtained by dividing said delay time corresponding to said difference by unit delay time of said delay means and sets a coefficient of said all-pass filter in correspondence to a decimal part of said quotient so that said all-pass filter provides delay time corresponding to said decimal part.

4. A digital sound synthesizing device as defined in claim 3 wherein said coefficient of said all-pass filter having been set prior to generation of the sound is prevented from being changed during generation of the sound.

5. A digital sound synthesizing device as defined in claim 1 wherein, when generation of the sound of the desired pitch is to be started, said pitch setting means subtracts, from the signal delay time of the entire loop corresponding to the desired pitch, filter delay time corresponding to said filter coefficient supplied to said filter means, and said pitch setting means, on the basis of a difference between the signal delay time of the entire loop and the filter delay time, variably sets unit delay time to be provided by said delay means.

6. A digital sound synthesizing device as defined in claim 1 wherein, in response to the change in said filter coefficient caused during generation of said sound, said pitch setting means subtracts, from the signal delay time of the entire loop corresponding to the desired pitch, filter delay time corresponding to said filter coefficient supplied to said filter means, and wherein said pitch setting means, on the basis of a difference between the signal delay time of the entire loop and the filter delay time, sets the number of delay stages in said delay means and an interpolation coefficient of said interpolation means.

7. A digital sound synthesizing device as defined in claim 6 wherein said pitch setting means sets the number of delay stages in said delay means in correspondence to an integer part of a quotient obtained by dividing said delay time corresponding to said difference by unit delay time of said delay means and sets said interpolation coefficient of said interpolation means in correspondence to a decimal part of said quotient so that said interpolation means provides delay time corresponding to said decimal part.

8. A digital sound synthesizing device as defined in claim 1 wherein said pitch setting means includes means for, in response to the desired pitch designated by pitch designation information, variably controlling delay time to be provided by said delay means, and means including an all-pass filter inserted in said loop and provided for, via said all-pass filter, providing a delay smaller than unit delay time that is controllable by said delay means in response to the desired pitch designated by pitch designation information.

9. A digital sound synthesizing device comprising:

signal circulating means forming a closed loop for circulating therein a digital signal, said signal circulating means including, within said closed loop, delay means for delaying the digital signal and filter means for filtering the digital signal;

excitation means for exciting the digital signal in said loop of said signal circulating means;

pitch setting means for, in accordance with a desired pitch, setting signal delay time in said loop, said digital signal being circulated in correspondence to the signal delay time so as to cause oscillation of a sound of the desired pitch in said loop, said pitch setting means including means for, in response to the desired pitch designated by pitch information prior to generation of the sound, variably controlling delay time to be provided by said delay means, and means including an all-pass filter inserted in said loop and provided for setting a characteristic of said all-pass filter in such a manner that said all-pass filter provides a delay smaller than unit delay time that is controllable by said delay means in response to the desired pitch designated by pitch designation information;

filter coefficient supplying means for supplying said filter means with a filter coefficient for controlling a resonance characteristic in said closed loop; and interpolation means for adjusting the signal delay time in said loop by, in response to a change in at least one of said filter coefficient and said pitch information caused during generation of said sound, interpolatively synthesizing outputs from plural points of said loop having different respective delay times to thereby control the signal delay time in said loop.

10. A digital sound synthesizing device comprising:

signal circulating means forming a closed loop for circulating therein a digital signal, said signal circulating means including, within said closed loop, delay means for delaying the digital signal and filter means for filtering the digital signal;

excitation means for exciting the digital signal in said loop of said signal circulating means;

filter coefficient supplying means for supplying said filter means with a filter coefficient for controlling a resonance characteristic in said closed loop;

pitch setting means for, in accordance with a desired pitch, setting signal delay time in said loop, said digital signal being circulated in correspondence to the delay time so as to cause oscillation of a sound of the desired pitch in said loop, said pitch setting means including means for, in response to delay time to be provided by said filter means determined by said filter coefficient and said desired pitch designated by pitch information when generation of said sound is to be started, variably controlling delay time to be provided by said delay means, and means including an all-pass filter inserted in said loop and provided for setting a characteristic of said all-pass filter in such a manner that said all-pass filter provides a delay smaller than unit delay time that is controllable by said delay means in response to the delay time to be provided by said filter means determined by said filter coefficient and said desired pitch designated by pitch information when generation of said sound is to be started; and interpolation means for adjusting the signal delay time in said loop by, in response to a change in at least one of said filter coefficient and said pitch information caused during generation of said sound, interpolatively synthesizing outputs from plural points of said loop having different respective delay times to thereby control the signal delay time in said loop.

11. A digital sound synthesizing device comprising:

signal circulating means forming a closed loop for circulating therein a digital signal, said signal circulating means including, within said closed loop, delay means for delaying the digital signal and filter means for filtering the digital signal;

excitation means for exciting the digital signal in said loop of said signal circulating means;

pitch setting means for, in accordance with a desired pitch, setting signal delay time in said loop, said digital signal being circulated in correspondence to the signal delay time so as to cause oscillation of a sound of the desired pitch in said loop;

means including an all-pass filter inserted in said loop and provided for, when generation of said sound is to be started, setting a characteristic of said all-pass filter in such a manner that said all-pass filter provides a delay smaller than unit delay time of desired signal delay time in said loop that is controllable by said delay means; and interpolation means inserted in said loop for interpolatively synthesizing outputs from plural points of said loop having different respective delay times to thereby control the signal delay time in said loop, in order to variably control a total signal delay time in said loop during generation of said sound.

12. A digital sound synthesizing device comprising:

signal circulating means forming a closed loop for circulating therein a digital signal, said signal circulating means including, within said closed loop, delay means for delaying the digital signal and filter means for filtering the digital signal;

excitation means for exciting the digital signal in said loop of said signal circulating means;

pitch setting means for, in accordance with a desired pitch, setting signal delay time in said loop, said digital signal being circulated in correspondence to the delay time so as to cause oscillation of a sound of the desired pitch in said loop, said pitch setting means including means for, in response to desired signal delay time in said loop, setting delay time to be provided by said delay means when generation of said sound is to be started;

means including a first digital filter inserted in said loop and provided for, at the start of generation of said sound, setting a characteristic of said first digital filter in such a manner that said first digital filter provides a delay exceeding delay time of desired signal delay time in said loop that is to be provided by said delay means; and means including a second digital filter inserted in said loop and provided for variably controlling a coefficient to be supplied to said second digital filter in order to variably control total signal delay time in said loop during generation of said sound.

13. A digital sound synthesizing device as defined in claim 12 wherein said means including said second digital filter variably controls said coefficient in order to vary the pitch of said sound during generation of said sound.

14. A digital sound synthesizing device as defined in claim 12 which further comprises means including a third digital filter inserted in said loop for controlling a resonance characteristic in said loop, and provided for, during generation of said sound, variably controlling a coefficient to be supplied to said third digital filter to thereby variably control color of said sound, and wherein said means including said second digital filter, during generation of said sound, performs control to compensate for a variation in said signal delay time resultant from a change in the coefficient of said third digital filter.

15. A digital sound synthesizing device as defined in claim 12 wherein said first digital filter comprises an all-pass filter.

16. A digital sound synthesizing device as defined in claim 12 wherein said second digital filter comprises a finite impulse response type filter.

17. A method for synthesizing a digital sound comprising:

circulating a digital signal within a closed loop including delay means for delaying the digital signal and filter means for filtering the digital signal;

exciting the digital signal in said closed loop;

setting signal delay time in said loop in accordance with a desired pitch of said digital sound, said digital signal being circulated in correspondence to the signal delay time so as to cause oscillation of a sound of the desired pitch in said loop;

supplying said filter means with a filter coefficient for controlling a resonance characteristic in said closed loop; and adjusting the signal delay time in said loop by, in response to a change in said filter coefficient caused during generation of said sound, interpolatively synthesizing outputs from plural points of said loop having different respective delay times to thereby compensate for a variation in said signal delay time resultant from said change in the filter coefficient.

18. A method for synthesizing a digital sound comprising:

circulating a digital signal within a closed loop including delay means for delaying the digital signal and filter means for filtering the digital signal;

exciting the digital signal in said loop;

setting signal delay time in said loop in accordance with a desired pitch, said digital signal being circulated in correspondence to the signal delay time so as to cause oscillation of a sound of the desired pitch in said loop, said setting step further including variably controlling delay time to be provided by said delay means in response to the desired pitch designated by pitch information prior to generation of the sound, and setting a characteristic of an all-pass filter inserted in said loop to provide a delay smaller than unit delay time that is controllable by said delay means in response to the desired pitch designated by said pitch designation information;

supplying said filter means with a filter coefficient for controlling a resonance characteristic in said closed loop; and adjusting the signal delay time in said loop by, in response to a change in at least one of said filter coefficient and said pitch information caused during generation of said sound, interpolatively synthesizing outputs from plural points of said loop having different respective delay times to thereby control the signal delay time in said loop.

19. A method for synthesizing a digital sound comprising:

circulating a digital signal within a closed loop including delay means for delaying the digital signal and filter means for filtering the digital signal;

exciting the digital signal in said loop;

supplying said filter means with a filter coefficient for controlling a resonance characteristic in said closed loop;

setting a signal delay time in said loop in accordance with a desired pitch, said digital signal being circulated in correspondence to the delay time so as to cause oscillation of a sound of the desired pitch in said loop, said setting step further including variably controlling a delay time to be provided by said delay means in response to a delay time to be provided by said filter means determined by said filter coefficient and said desired pitch designated by pitch information when generation of said sound is to be started, and setting a characteristic of an all-pass filter in said loop in such a manner that said all-pass filter provides a delay smaller than a unit delay time that is controllable by said delay means in response to the delay time to be provided by said filter means determined by said filter coefficient and said desired pitch designated by pitch information when generation of said sound is to be started; and adjusting the signal delay time in said loop by, in response to a change in at least one of said filter coefficient and said pitch information caused during generation of said sound, interpolatively synthesizing outputs from plural points of said loop having different respective delay times to thereby control the signal delay time in said loop.

20. A method for synthesizing a digital sound comprising:

circulating a digital signal within a closed loop including delay means for delaying the digital signal and filter means for filtering the digital signal;

exciting the digital signal in said loop;

setting a signal delay time in said loop in accordance with a desired pitch, said digital signal being circulated in correspondence to the signal delay time so as to cause oscillation of a sound of the desired pitch in said loop;

setting a characteristic of an all-pass filter provided in said loop in such a manner that said all-pass filter provides a delay smaller than unit delay time of desired signal delay time in said loop that is controllable by said delay means when generation of said sound is to be started; and interpolatively synthesizing outputs from plural points of said loop having different respective delay times to thereby control the signal delay time in said loop, in order to variably control a total signal delay time in said loop during generation of said sound.

21. A method for synthesizing a digital sound comprising:

forming a closed loop for circulating therein a digital signal, said closed loop including delay means for delaying the digital signal and filter means for filtering the digital signal;

exciting the digital signal in said loop;

setting signal delay time in said loop in accordance with a desired pitch, said digital signal being circulated in correspondence to the delay time so as to cause oscillation of a sound of the desired pitch in said loop, said setting step including setting delay time to be provided by said delay means in response to desired signal delay time in said loop when generation of said sound is to be started;

setting a characteristic of a first digital filter inserted in said loop in such a manner that said first digital filter provides a delay exceeding delay time of desired signal delay time in said loop that is to be provided by said delay means at the start of generation of said sound; and variably controlling a coefficient to be supplied to a second digital filter inserted in said in order to variably control total signal delay time in said loop during generation of said sound.

* * * * *